US007638764B2

(12) United States Patent
Ivosev

(10) Patent No.: US 7,638,764 B2
(45) Date of Patent: Dec. 29, 2009

(54) SYSTEMS AND METHODS FOR REDUCING NOISE FROM MASS SPECTRA

(75) Inventor: Gordana Ivosev, Etobicoke (CA)

(73) Assignees: MDS Analytical Technologies, Concord, Ontario (CA); Applied Biosystems Inc., Framingham, MA (US)

( * ) Notice: Subject to any disclaimer, the term of this patent is extended or adjusted under 35 U.S.C. 154(b) by 162 days.

(21) Appl. No.: 12/023,873

(22) Filed: Jan. 31, 2008

(65) Prior Publication Data

US 2008/0185510 A1 Aug. 7, 2008

Related U.S. Application Data

(60) Provisional application No. 60/887,915, filed on Feb. 2, 2007.

(51) Int. Cl.
*H01J 49/26* (2006.01)
*H01J 49/00* (2006.01)

(52) U.S. Cl. ..... 250/282; 250/281; 250/288; 250/397; 702/23

(58) Field of Classification Search ..... 250/282, 250/281, 288, 397; 702/23
See application file for complete search history.

(56) References Cited

U.S. PATENT DOCUMENTS 6,147,344 A 11/2000 Annis et al.
6,449,584 B1 9/2002 Bertrand et al.
6,590,204 B2 * 7/2003 Baranov ..... 250/282
6,836,742 B2 * 12/2004 Brekenfeld ..... 702/104

(Continued)

FOREIGN PATENT DOCUMENTS

GB 2409568 A 6/2005

(Continued)

OTHER PUBLICATIONS

Dariya I. Malyarenko et al. "Enhancement of sensitivity and resolution of surface-enhanced laser desorption/ionization Time-of-Flight mass spectrometic records for serum peptides using time-series analysis techniques": Clinical Chemistry, 51:1, 2005, pp. 1-10, U.S.

(Continued)

*Primary Examiner*—Nikita Wells
(74) *Attorney, Agent, or Firm*—Bereskin & Parr LLP/S.E.N.C.R.L., s.r.l.

(57) ABSTRACT

Systems and methods for reducing background noise in a mass spectrum. The method includes the following steps of: (a) obtaining an original mass spectrum; (b) determining a noise mass spectrum corresponding to background noise in the original mass spectrum; and (c) determining a corrected mass spectrum by subtracting the noise mass spectrum from the original mass spectrum. Step (b) of the method may include the steps of: A) effecting a transformation of the original mass spectrum into the frequency domain to obtain an original frequency spectrum; B) identifying at least one dominant frequency in the original frequency spectrum; C) generating a noise frequency spectrum by selectively filtering for said dominant frequencies; and D) determining the noise mass spectrum by effecting a transformation of the noise frequency spectrum into the mass domain. Preferably for each correlated pair of original and noise intensity data points, the minimum value is determined and the noise mass spectrum is modified by making the noise intensity data point equal to the minimum value.

12 Claims, 16 Drawing Sheets

U.S. PATENT DOCUMENTS

| | | | | |
|---|---|---|---|---|
| 7,365,309 | B2 * | 4/2008 | Denny et al. | 250/282 |
| 7,409,298 | B2 * | 8/2008 | Andreev et al. | 702/23 |
| 2002/0063208 | A1 | 5/2002 | Hastings | |
| 2005/0023611 | A1 | 2/2005 | Wieczorek et al. | |

FOREIGN PATENT DOCUMENTS

| | | | |
|---|---|---|---|
| JP | 2000206103 | | 7/2000 |
| WO | 01/35266 | A2 | 5/2001 |

OTHER PUBLICATIONS

Xiao-Jun Li et al. "A software suite for the generation and comparison of peptide arrays from sets of data collected by liquid chromatography-mass spectrometry": Molecular & Cellular Proteomics, 4:1328-1340, 2005, U.S.

Xiao-Jun Li et al. "Automated statistical analysis of protein abundance ratios from data generated by stable-isotope dilution and tandem mass spectrometry": Analytical Chemistry, vol. 75, No. 23, Dec. 1, 2003, pp. 6648-6657, U.S.

Written Opinion and International Search Report. Application No. PCT/CA2008/000209. Dated May 20, 2008.

International Preliminary Report on Patentability. Application No. PCT/CA2008/000209, dated Aug. 4, 2009.

Jürgen Kast, Marc Gentzel, Keith Richardson, Matthias Wilm. Noise Filtering Techniques for Electrospray Quadrupole Time of Flight Mass Spectra, Journal of the American Society for Mass Spectrometry, Jul. 2003, pp. 766-776, vol. 14, Issue 7, Elsevier Science B.V.

FTIRsearch.com, "Algorithms—Gifts Auto-baseline Leveling." Retrived from Internet: https://ftirsearch.com/help/algo.htm.

FTIRsearch, "Frequently Asked Questions" Retrived from Internet: https://ftirsearch.com/support/faq_spectrumsearch.htm.

* cited by examiner

76

SYSTEMS AND METHODS FOR REDUCING NOISE FROM MASS SPECTRA

FIELD OF THE INVENTION

The present invention relates generally to the field of mass spectrometry.

BACKGROUND OF THE INVENTION

Mass spectrometers are used for producing a mass spectrum of a sample to find its composition. This is normally achieved by ionizing the sample and separating ions of differing masses and recording their relative abundance by measuring intensities of ion flux.

Typically, the mass spectra are subject to background noise, obscuring the real signal.

The applicants have accordingly recognized a need for new systems and methods for reducing or removing noise from mass spectra.

SUMMARY OF THE INVENTION

In one aspect, the present invention is directed towards a method for reducing background noise in a mass spectrum. The method includes the following steps:

(a) obtaining an original mass spectrum;

(b) determining a noise mass spectrum corresponding to background noise in the original mass spectrum; and (c) determining a corrected mass spectrum by subtracting the noise mass spectrum from the original mass spectrum.

Step (b) of the method may include the steps of:

A) effecting a transformation of the original mass spectrum into the frequency domain to obtain an original frequency spectrum;

B) identifying at least one dominant frequency in the original frequency spectrum;

C) generating a noise frequency spectrum by selectively filtering for said at least one dominant frequency; and D) determining the noise mass spectrum by effecting a transformation of the noise frequency spectrum into the mass domain.

With the method as claimed, the original mass spectrum may be provided with a plurality of original intensity data points and the noise mass spectrum may also be provided with a plurality of noise intensity data points such that each noise intensity data point correlates to an original intensity data point. The method may further include the following step:

E) for each correlated pair of original and noise intensity data points:

(i) determining the minimum value; and (ii) modifying the noise mass spectrum by making the noise intensity data point equal to the minimum value.

BRIEF DESCRIPTION OF THE DRAWINGS

The present invention will now be described, by way of example only, with reference to the following drawings, in which like reference numerals refer to like parts and in which.

DETAILED DESCRIPTION OF THE INVENTION

Figure 1:
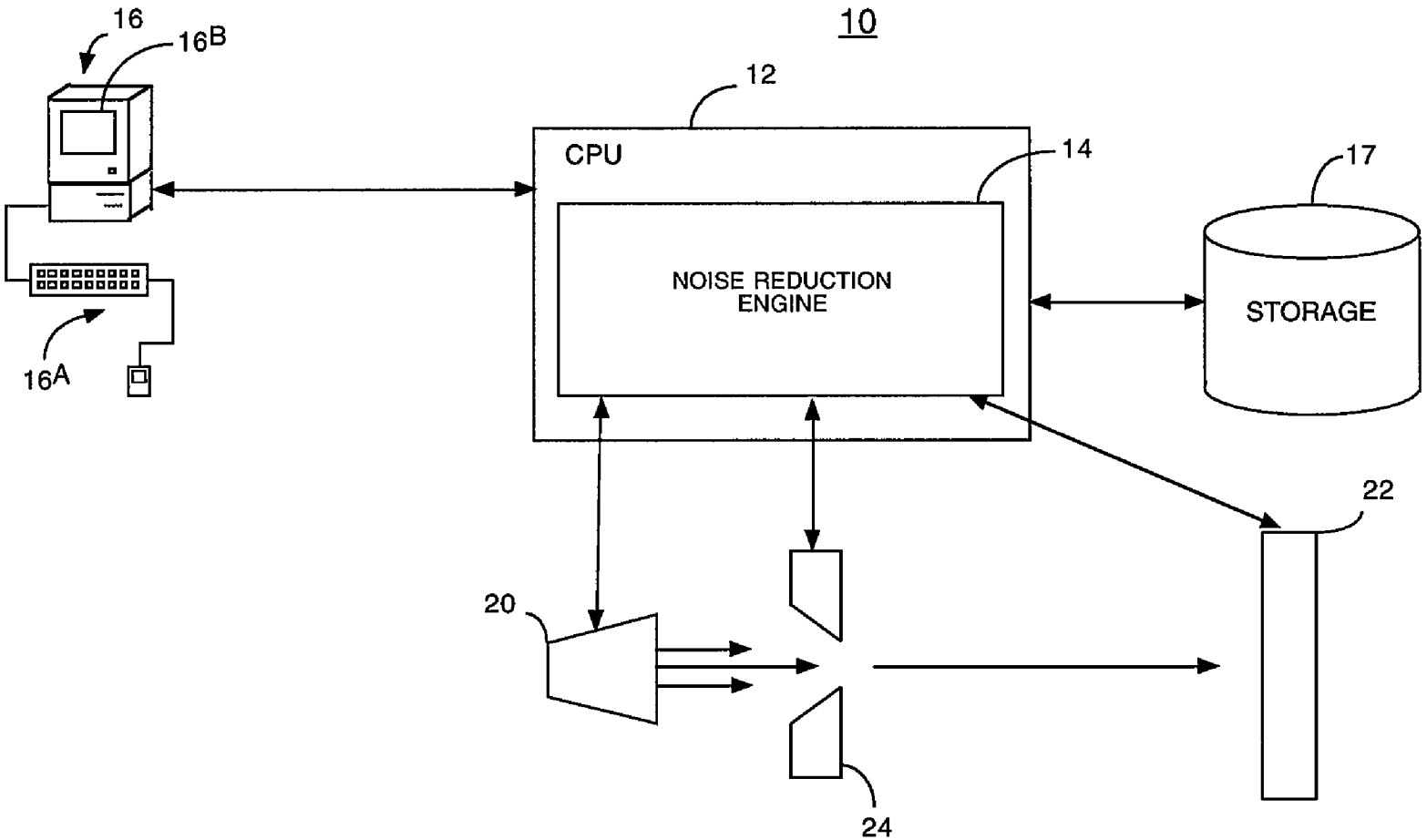
FIG. 1 is a schematic diagram of a noise reducing system made in accordance with the present invention.

Referring to FIG. 1, illustrated therein is a noise reducing system, referred to generally as 10, made in accordance with the present invention. The system 10 comprises a processor or central processing unit (CPU) 12 having a suitably programmed noise reduction engine 14. The programming for the engine 14 may also be saved on storage media for example such as a computer disc or CD-ROM. An input/output (I/O) device 16 (typically including a data input component $\mathbf{16}^A$, and an output component such as a display $\mathbf{16}^B$) is also operatively coupled to the CPU 12. As will be understood, preferably the data input component $\mathbf{16}^A$ will be configured to receive mass spectrum and/or frequency domain data, and the display $\mathbf{16}^B$ will similarly be configured to graphs corresponding to mass spectra and frequency domains.

Data storage 17 is also preferably provided in which may be stored mass spectrum and frequency domain data.

As will be understood, the system 10 may be a stand-alone analysis system for reducing noise in a mass spectrum (or frequency domain data). In the alternative, the system 10 may (but does not necessarily have to) comprise part of a spectrometer system having an ion source 20, configured to emit a beam of ions, generated from a sample to be analyzed.

A detector 22 (having one or more anodes or channels) may also be provided as part of the spectrometer system, which can be positioned downstream of the ion source 20, in the path of the emitted ions. Optics 24 or other focusing elements, such as an electrostatic lens can also be disposed in the path of the emitted ions, between the ion source 20 and the detector 22, for focusing the ions onto the detector 22.

Figure 2:
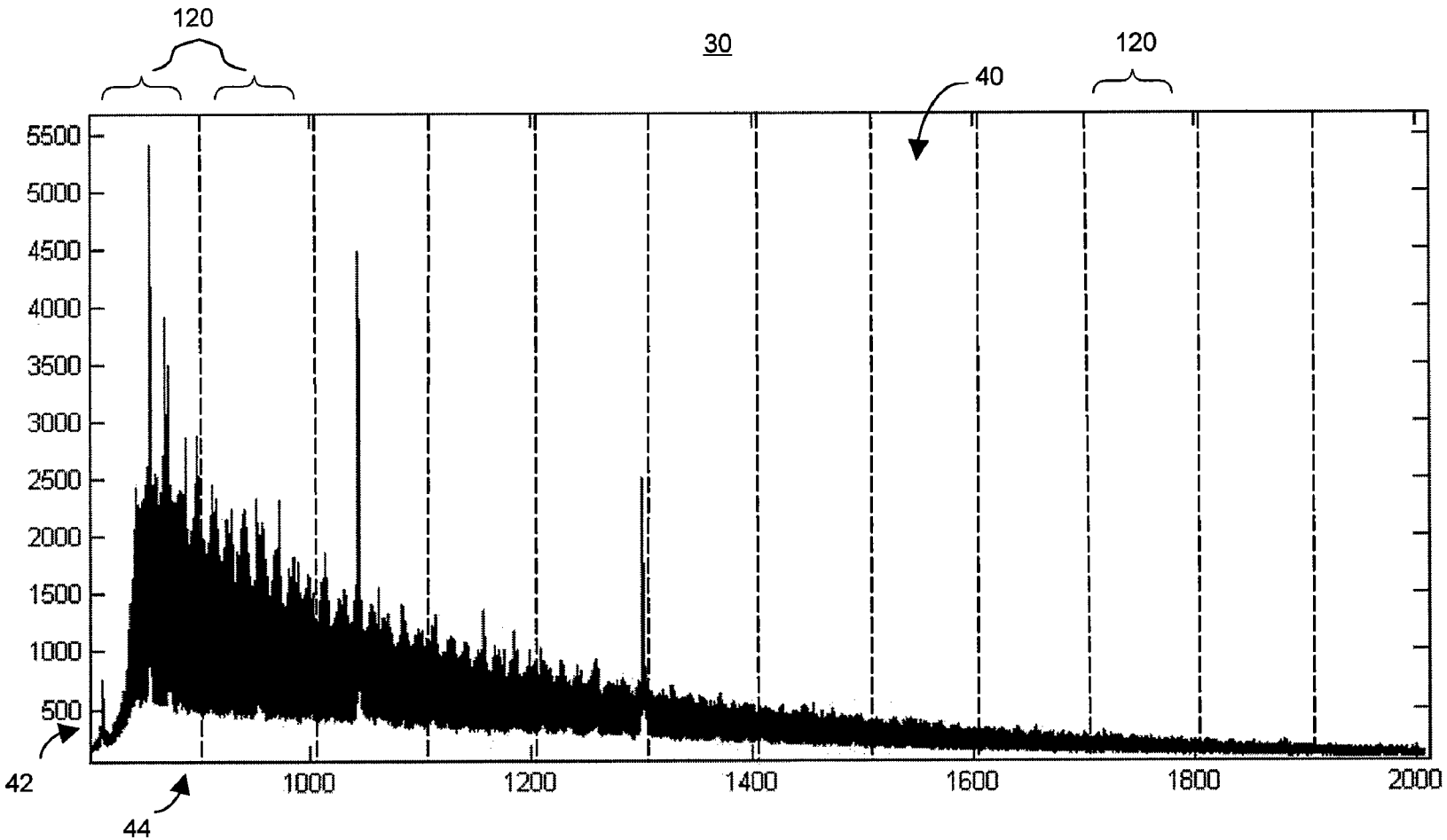
FIG. 2 is a graph illustrating an original mass spectrum as may be input into and manipulated by the system of FIG. 1.

Referring now to FIG. 2, illustrated therein is a graph 30 illustrating an original mass spectrum 40 as may be input into and analyzed by the system 10. The vertical axis 42 corresponds to signal intensity, while the horizontal axis 44 corresponds to m/z (mass/charge). The graph displays the original mass spectrum 40, which will typically comprise a real signal combined together with and obscured by a background noise or signal. As will be understood, the data corresponding to the original mass spectrum 40 is preferably input into and stored in the data storage 17, and typically the graph 30 is displayed on the display $\mathbf{16}^{B}$.

Figure 13:
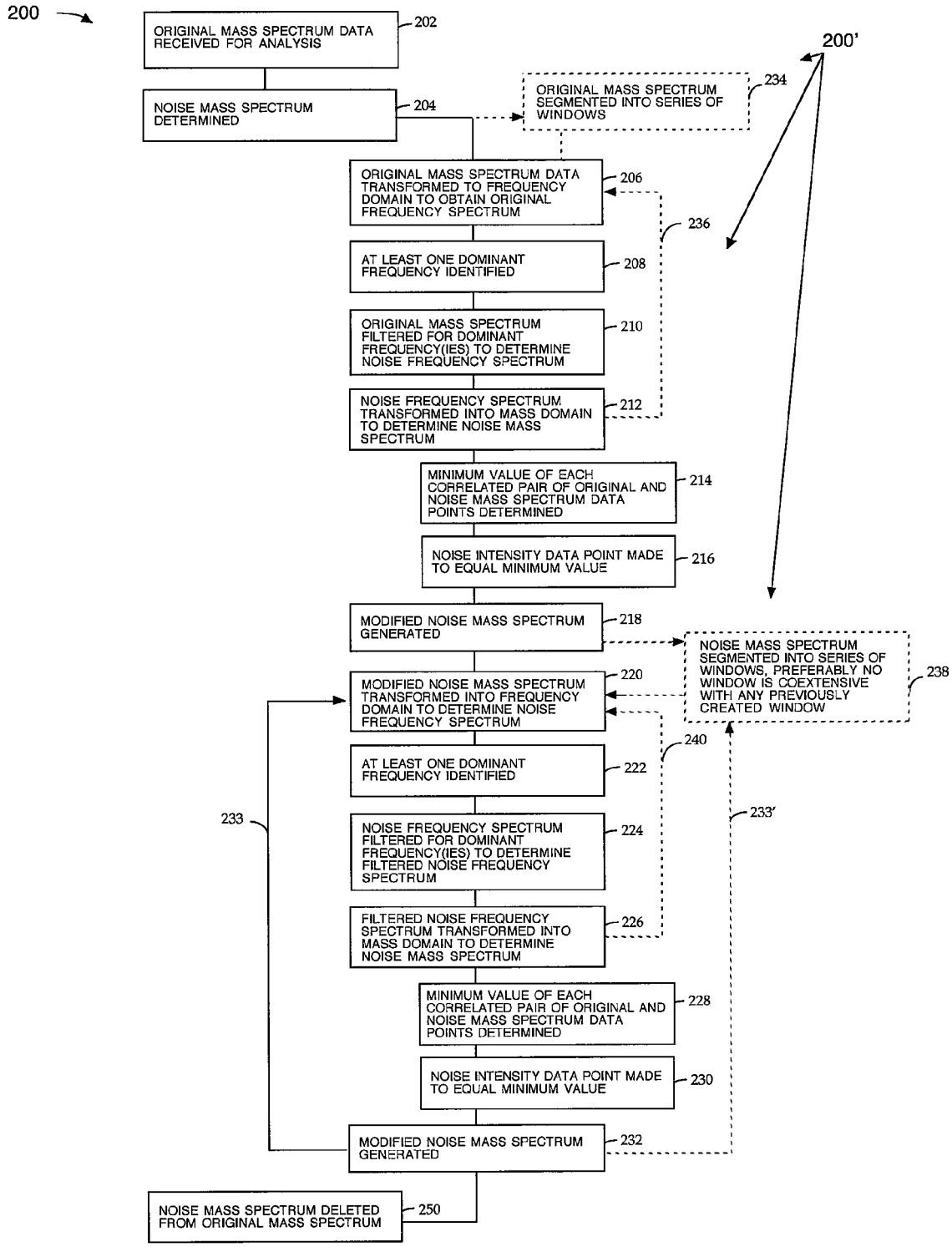
FIG. 13 is a flow diagram illustrating the steps of a method of reducing noise in a mass spectrum, in accordance with the present invention.

FIG. 13 sets out the steps of the method, referred to generally as 200, carried out by the noise reducing system 10. Data corresponding to an original mass spectrum 40 (illustrated in FIG. 2) is received (typically via the I/O device or determined by the system 10 if the system 10 comprises a spectrometer) and typically stored in data storage 17, and the noise reduction engine 14 is programmed to initiate the noise reduction analysis (Block 202). A noise mass spectrum corresponding to the background signal component in the original mass spectrum 40 is then determined (Block 204). As set out in the discussion relating to Blocks 206 to 232 below, this step may itself comprise a number of steps.

Figure 3A:
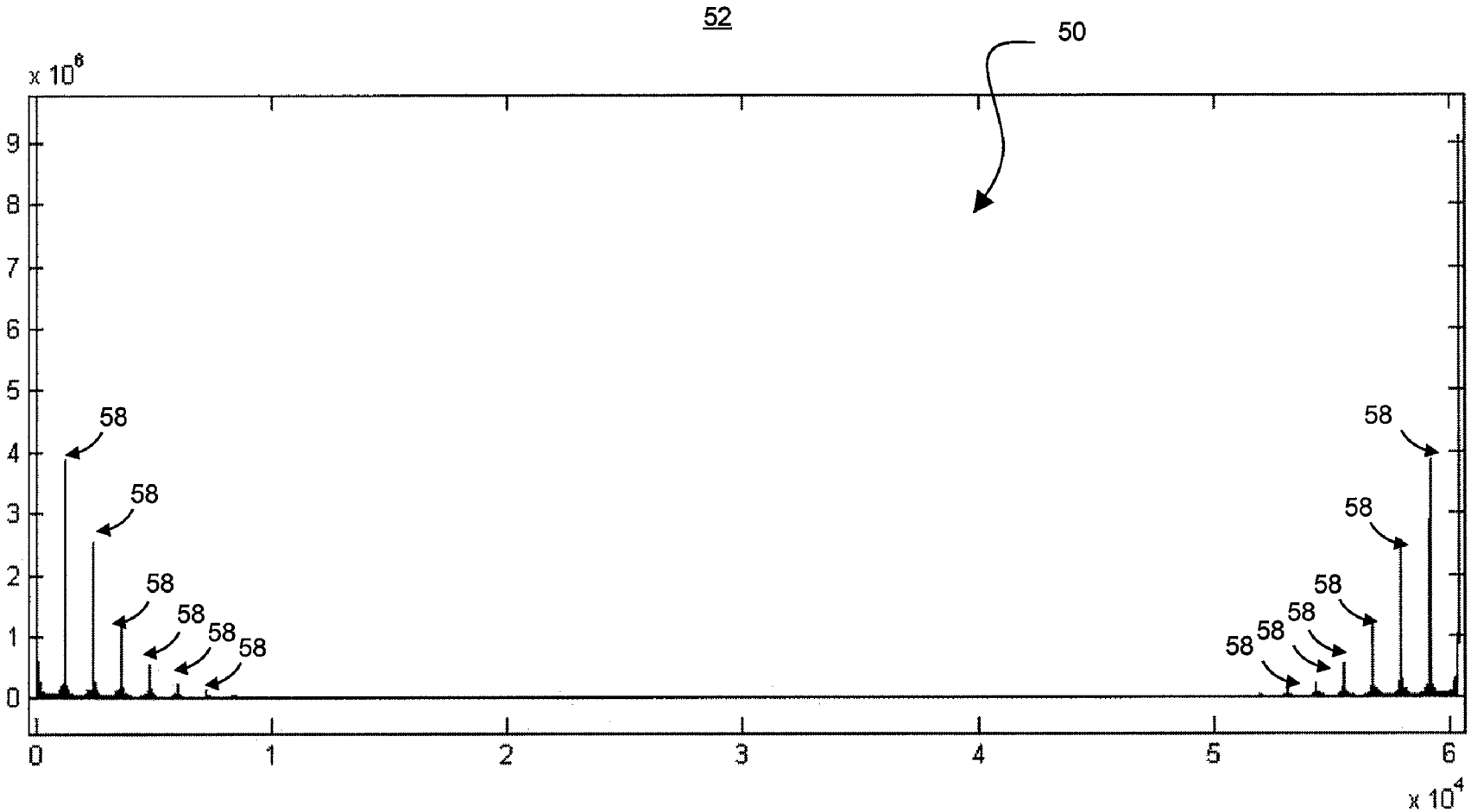
FIG. 3A is a graph illustrating an original frequency spectrum determined by transforming the original mass spectrum of FIG. 2 into the frequency domain.
Figure 3B:
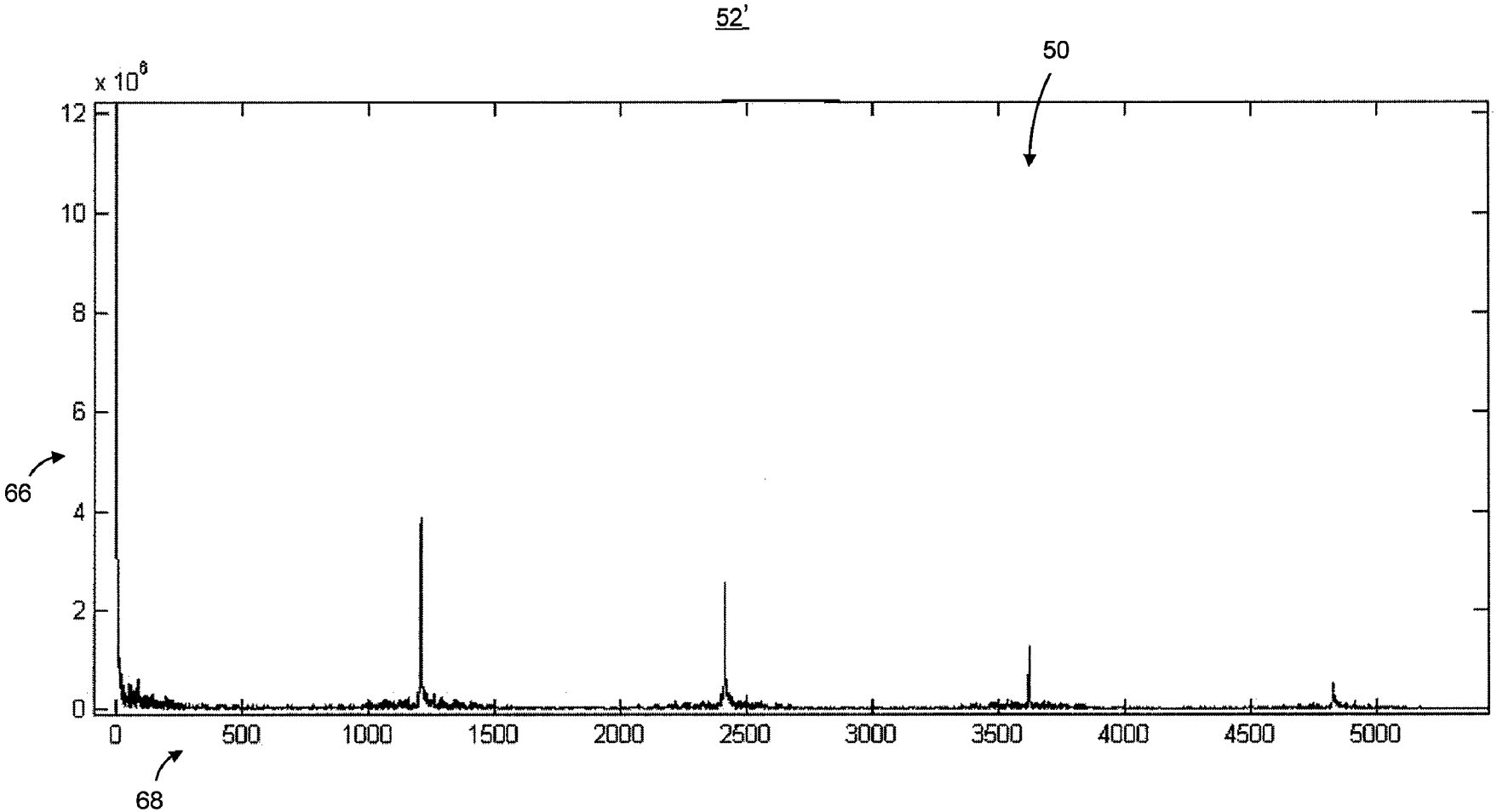
FIG. 3B is a magnified segment of the graph of FIG. 3A.

The engine 14 can be programmed to effect a transformation of the original mass spectrum 40 into the frequency domain (typically by subjecting the original mass spectrum 40 data to a Fourier Transformation, sine/cosine transform or any mathematical or experimental method known in the art) to obtain an original frequency spectrum 50, as illustrated in the graph 52 of FIG. 3A (a magnified segment of which is illustrated in the graph 52' of FIG. 3B) (Block 206). In the graph 52, the vertical axis 54 corresponds to intensity while the horizontal axis 56 corresponds to frequency.

The original frequency spectrum 50 comprises distinct peaks 58 corresponding to dominant frequencies. As will be understood, background noise is often periodic in nature, typically having a period of one atomic mass unit. Accordingly, a significant portion of the intensity of the dominant frequencies 58 may often be attributed to the noise component of the original mass spectrum 40. These dominant frequencies 58 will often correspond to the background noise's base frequency and corresponding harmonics thereof.

Figure 4:
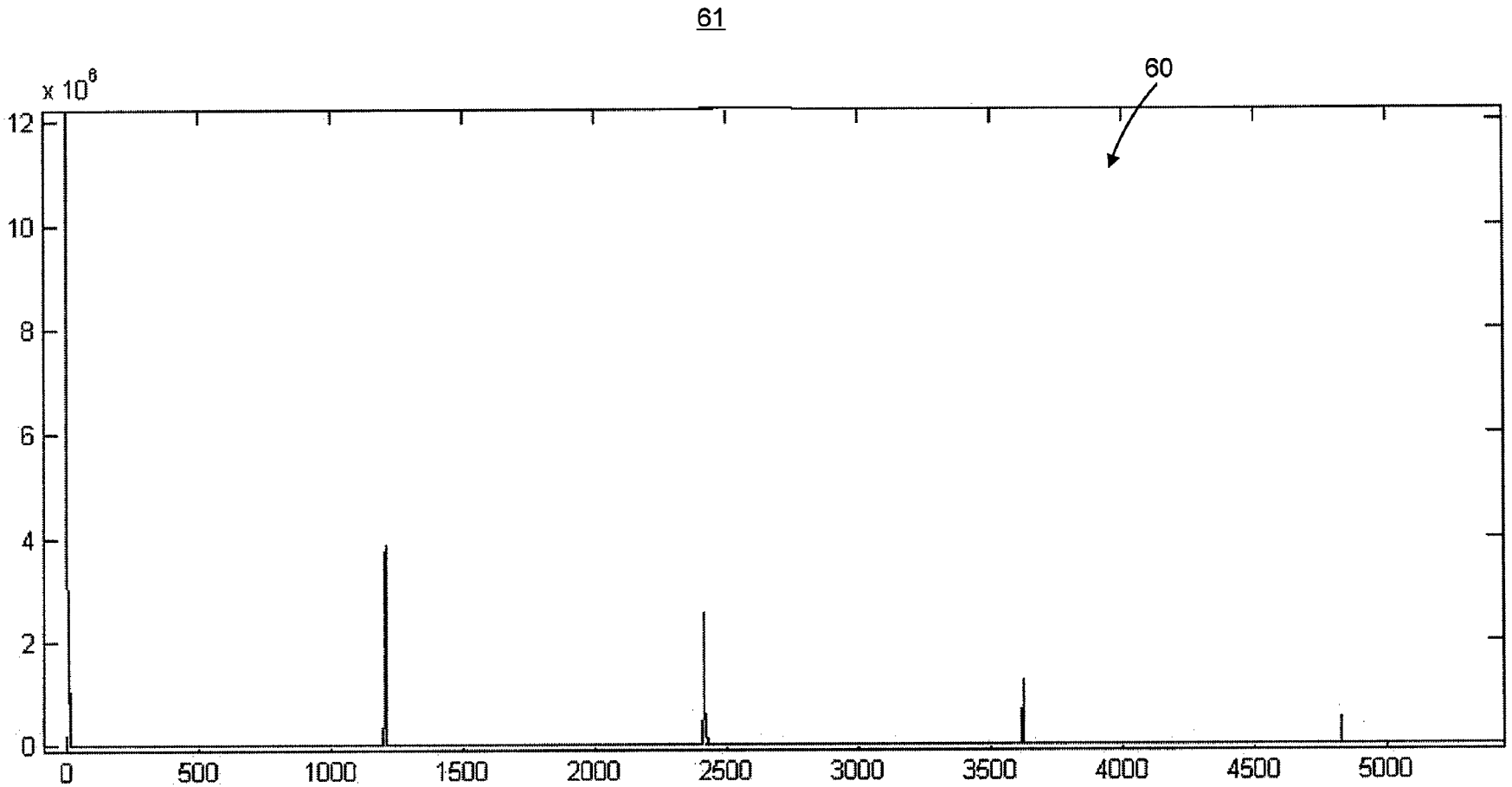
FIG. 4 is a graph illustrating a noise frequency spectrum made in accordance with the present invention and determined by selectively filtering for dominant frequencies in the original frequency spectrum of FIG. 3A.

The engine 14 preferably identifies at least one and preferably all of the dominant frequencies 58 in the original frequency spectrum 50 (although as will be understood, this step could be performed manually by a system 10 user) (Block 208). Next, the original frequency spectrum 50 is filtered for the identified dominant frequencies 58, in order to generate a noise frequency spectrum 60, as illustrated in the graph 61 of FIG. 4 (Block 210).

Figure 3C:
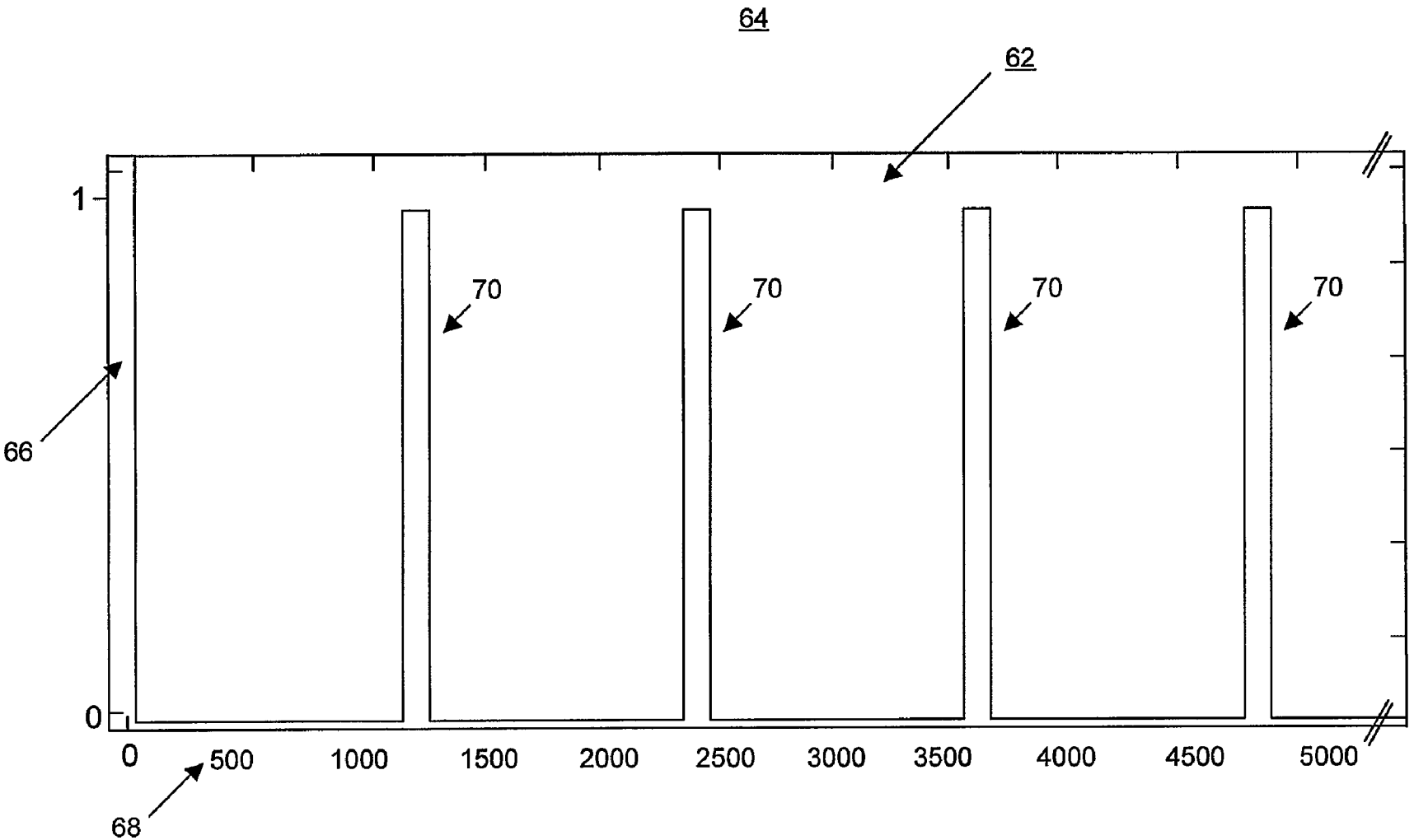
FIG. 3C is a schematic diagram of a segment of a filter made and used in accordance with the present invention to filter the original frequency spectrum of FIG. 3A, the segment corresponding to the original frequency segment illustrated in FIG. 3B.

To accomplish this, a filter 62, such as that depicted for illustrative purposes in the schematic graph 64 of FIG. 3C, may be created to selectively filter for the identified dominant frequencies 58. Typically the data filter 62 will be implemented through software in the reduction engine 14, and will often not be displayed to the end user. As can be seen, the vertical axis 66 represents the ratio (from 0 to 1) of the original frequency spectrum 50 to be retained or filtered for. The horizontal axis 68 corresponds to frequency. The filter 62 preferably comprises a plurality of tabs 70 corresponding to the number of dominant frequencies 58 identified in Block 208. As can be seen from the juxtaposition of FIGS. 3A and 3B, via the tabs 70, the filter 62 is configured to preserve or filter for 100% of the identified dominant frequencies 58 data. Conversely, the filter 62 discards the frequency data in the original frequency spectrum 50 not forming part of the identified dominant frequencies data 58, resulting in the noise frequency spectrum 60 data.

Figure 5:
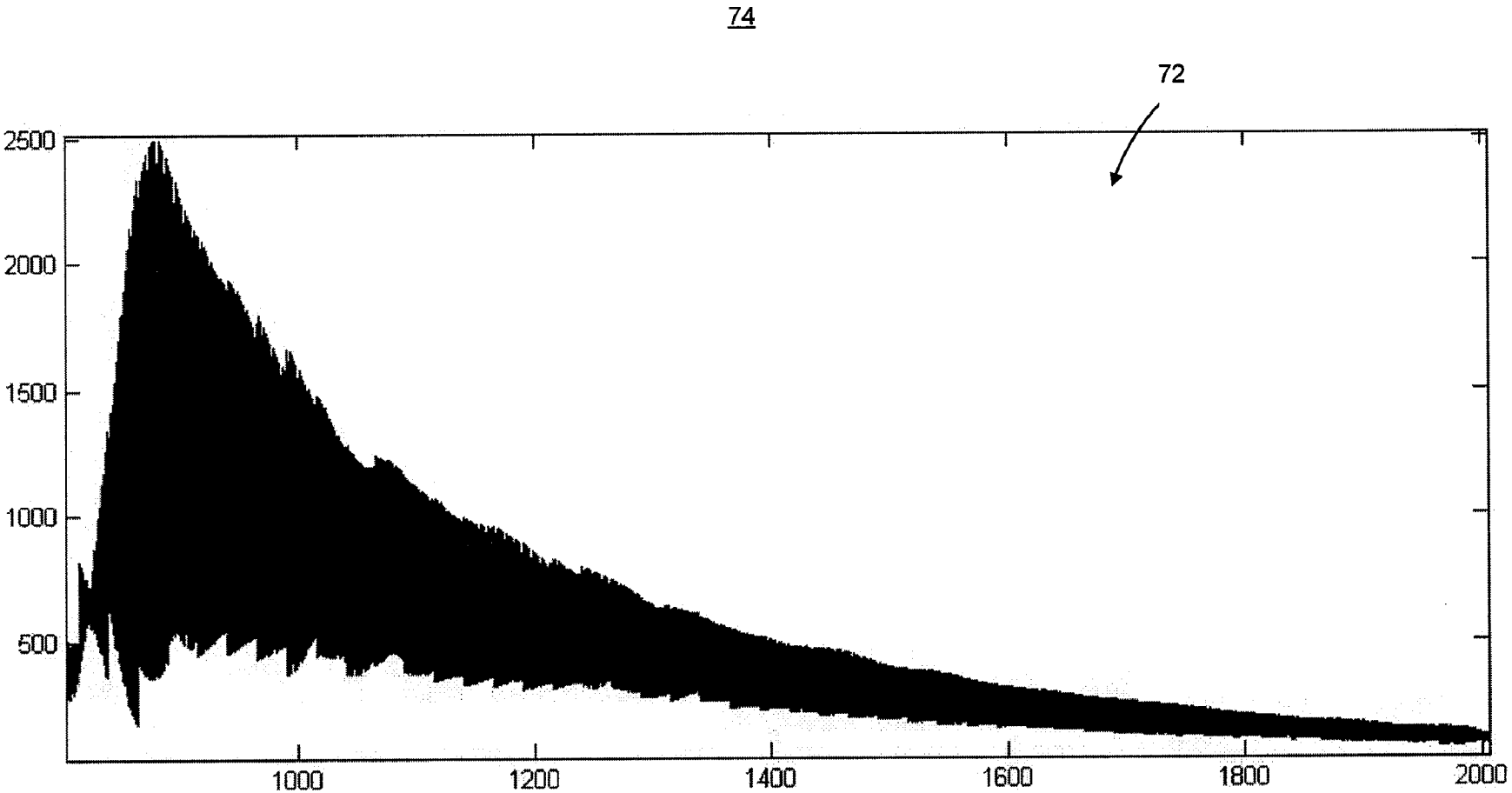
FIG. 5 is a graph illustrating a noise mass spectrum made in accordance with the present invention and determined by transforming the noise frequency spectrum of FIG. 4 into the mass domain.

Subsequently, the engine 14 is preferably configured to determine a noise mass spectrum 72 illustrated in the graph 74 of FIG. 5, typically by effecting an inverse Fourier transformation of the noise frequency spectrum 60 data into the mass domain (Block 212).

As will be understood, the noise mass spectrum 72 data represents an estimate of the background noise signal component of the original mass spectrum 40.

Figure 6:
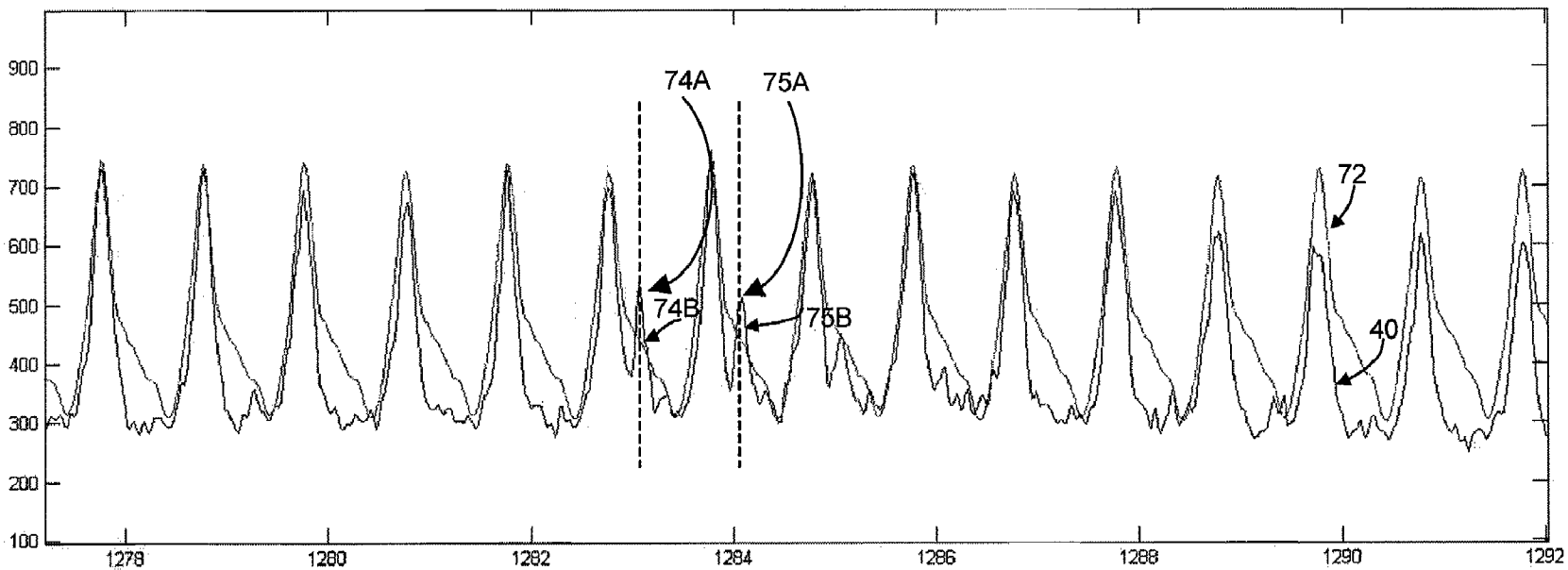
FIG. 6 is a graph illustrating a magnified portion of the noise mass spectrum of FIG. 5 overlaid together with a corresponding magnified portion of the original mass spectrum of FIG. 2.

Referring to FIG. 6, illustrated therein is a graph 76 overlay of a close-up segment of the original mass spectrum 40 with a corresponding magnified segment of the noise mass spectrum 72. As will be understood, the noise 72 and original 40 mass spectrums are formed of many thousands of data points. Data points in both mass spectrums 72 and 40 may be correlated as one data point should exist in each spectrum 40, 72 corresponding to each m/z value.

Referring to exemplary data points 74A and 74B (and 75A and 75B) of the original mass spectrum 40 and the noise mass spectrum 72, respectively, each pair is correlated to the same m/z value (as indicated by the dotted lines). It can be seen that the noise mass spectrum 72 may have a higher intensity value at certain m/z values than the original mass spectrum 40. However, as will be understood, this indicates an artifact in estimation of the background noise signal component, as the noise component should not exceed the combined background and real signals of the original mass spectrum 40 (at corresponding m/z values). This artifact is a result of the real peak(s) in the original mass spectrum 40, for example at points 74A, 75A where the original mass spectrum 40 has a higher intensity value than the corresponding points 74B, 75B on the noise mass spectrum 72.

Accordingly, to further refine the background signal estimate, the noise mass spectrum 72 data is revised such that for each correlated data point in the noise mass spectrum 72 and original mass spectrum 40 (having the same m/z value), the minimum intensity value of the two data points is determined (Block 214). In turn, the noise mass spectrum is preferably modified by making the noise intensity data point equal to the minimum value (Block 216).

For the sake of clarity, the steps of Blocks 214 and 216 may be implemented using the function set out in Equation 1, below:

$$f'(x)=\min(f(x), g(x)) \qquad \text{EQ. 1:}$$

where x represents m/z and f(x) represents the intensity value of the noise mass spectrum 72 and g(x) represents the intensity value of the original mass spectrum 40, and f'(x) represents the modified noise mass spectrum.

Figure 7A:
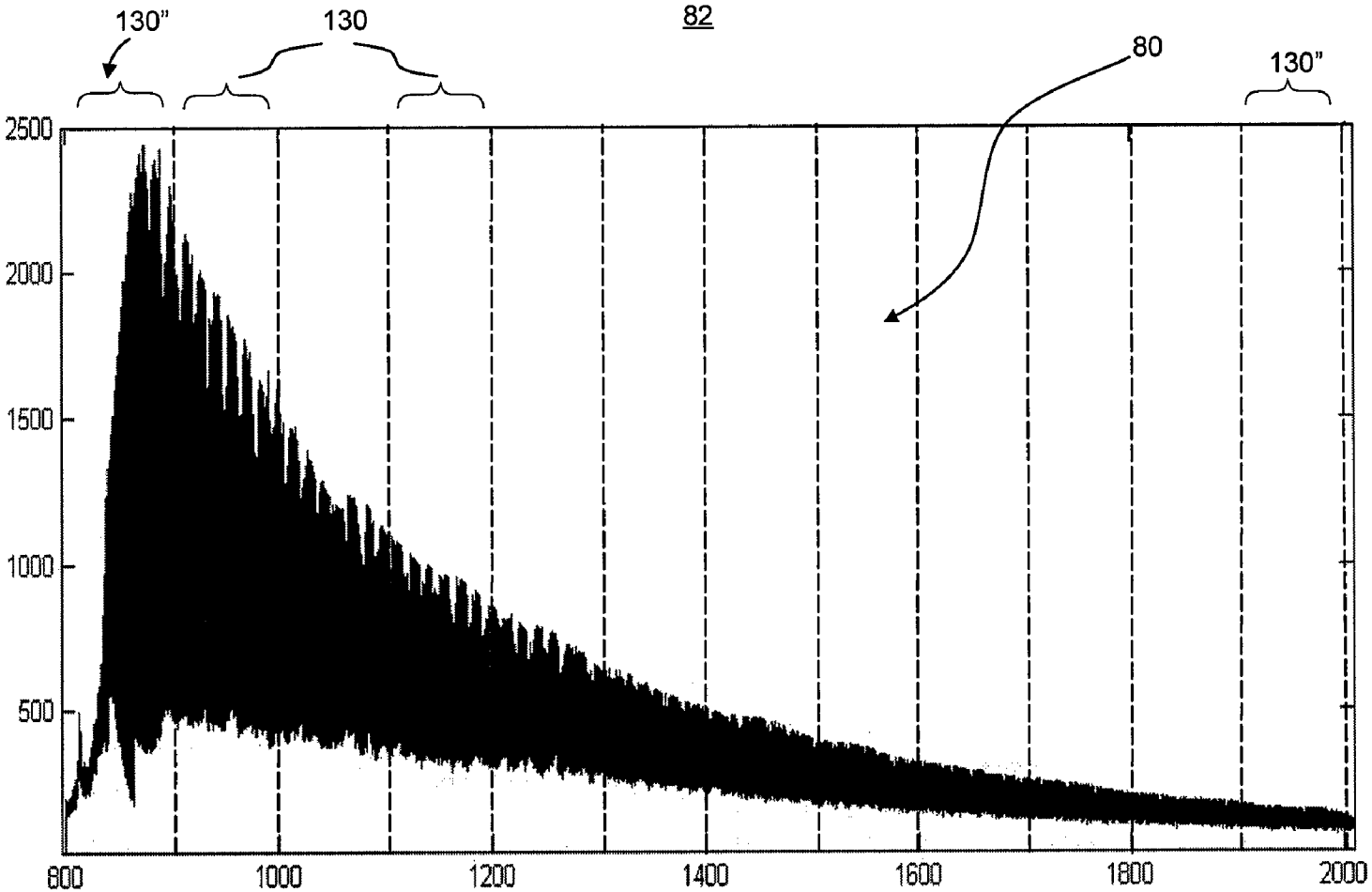
FIG. 7A is a graph illustrating the noise mass spectrum made in accordance with the present invention by determining the minimum value of each corresponding pair of intensity data points from the complete noise mass spectrum and original mass spectrum portions of which were illustrated in FIG. 6.
Figure 7B:
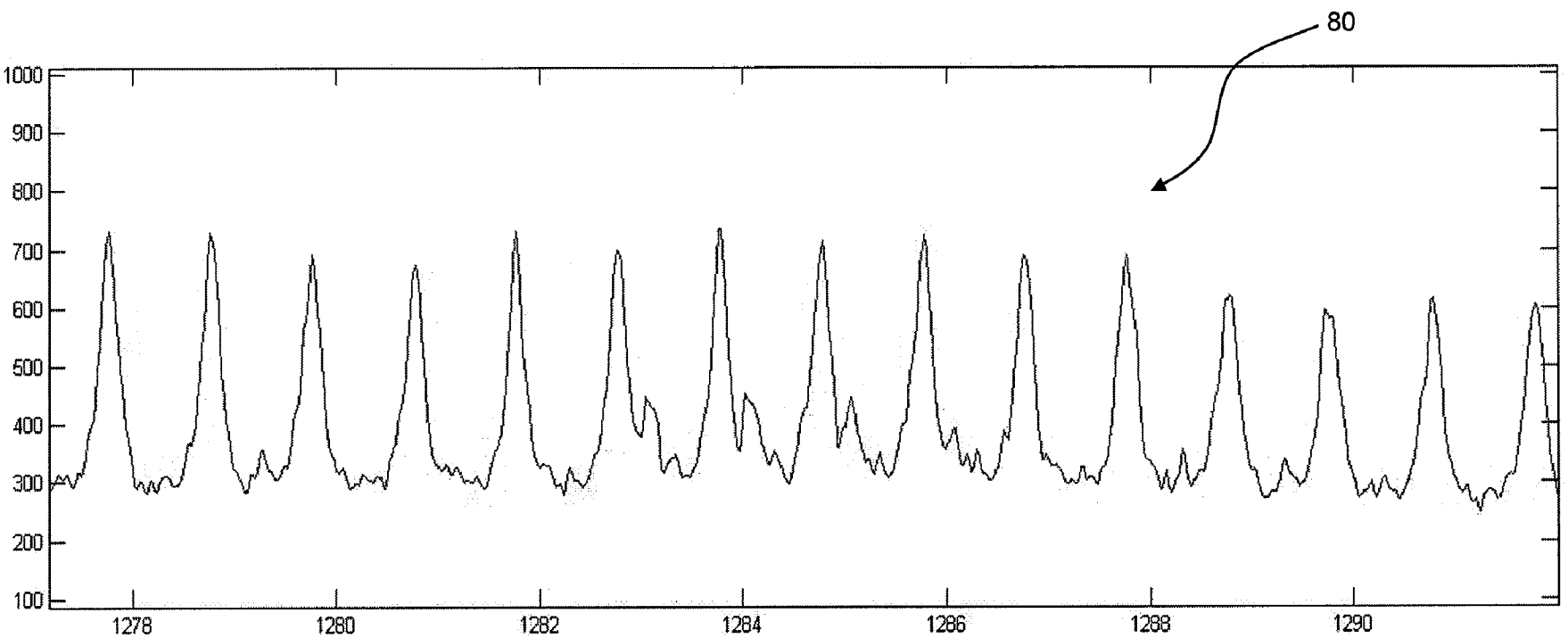
FIG. 7B is a graph illustrating a magnified portion of the noise mass spectrum of FIG. 7A corresponding to the magnified portions in FIG. 6.

Completion of Block 216 for all of the correlated data points in the original and noise mass spectrums 40, 72, results in a modified noise mass spectrum 80, as illustrated in the graph 82 of FIG. 7A (and 7B) (Block 218).

Figure 8:
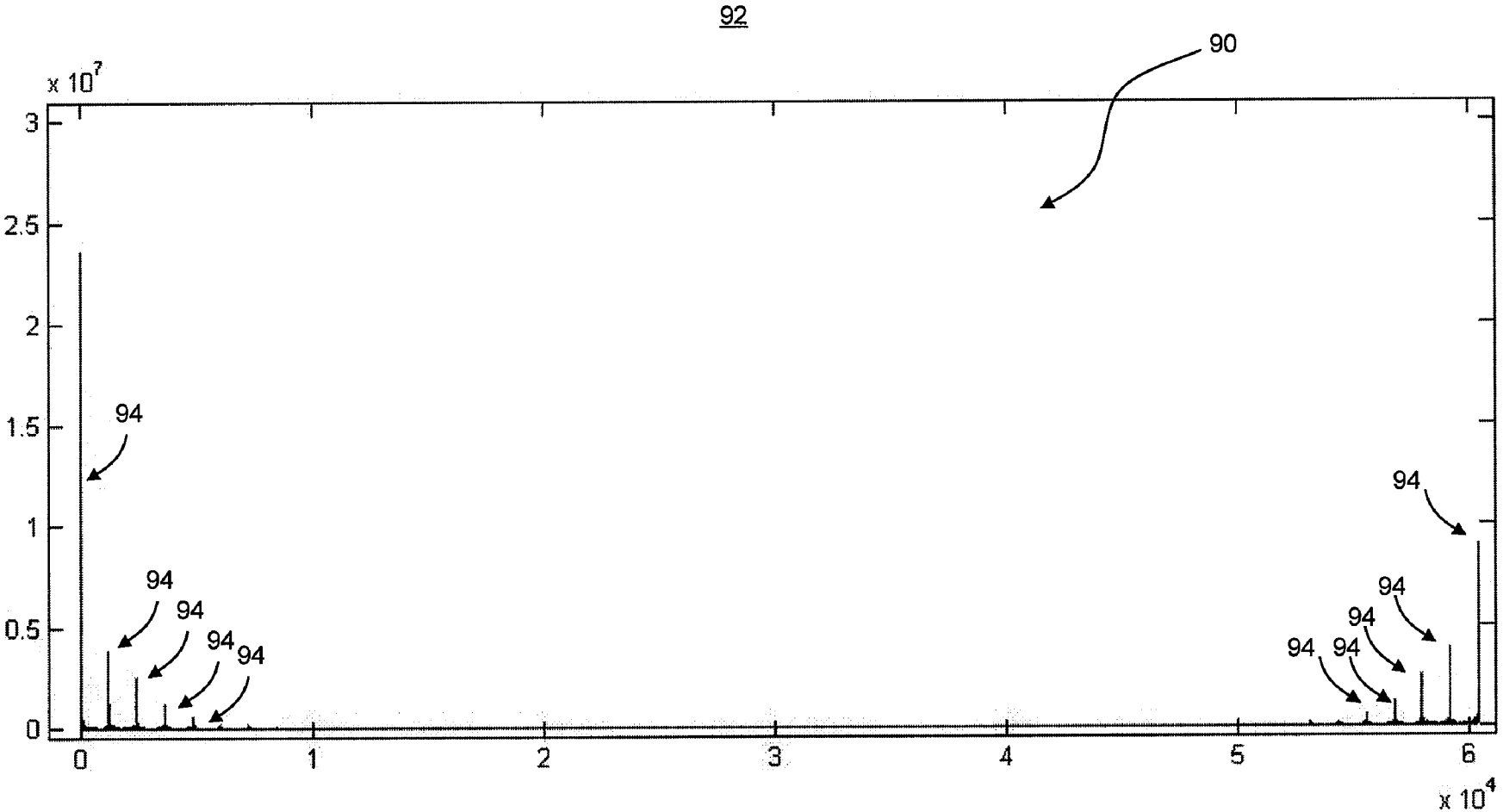
FIG. 8 is a graph illustrating a noise frequency spectrum determined by transforming the noise mass spectrum of FIG. 7A into the frequency domain.

Next, a transformation of the modified noise mass spectrum 80 into the frequency domain is effected (again, typically by subjecting the noise mass spectrum 80 data to a Fourier Transformation) to obtain a noise frequency spectrum 90, as illustrated in the graph 92 of FIG. 8 (Block 220).

Figure 9:
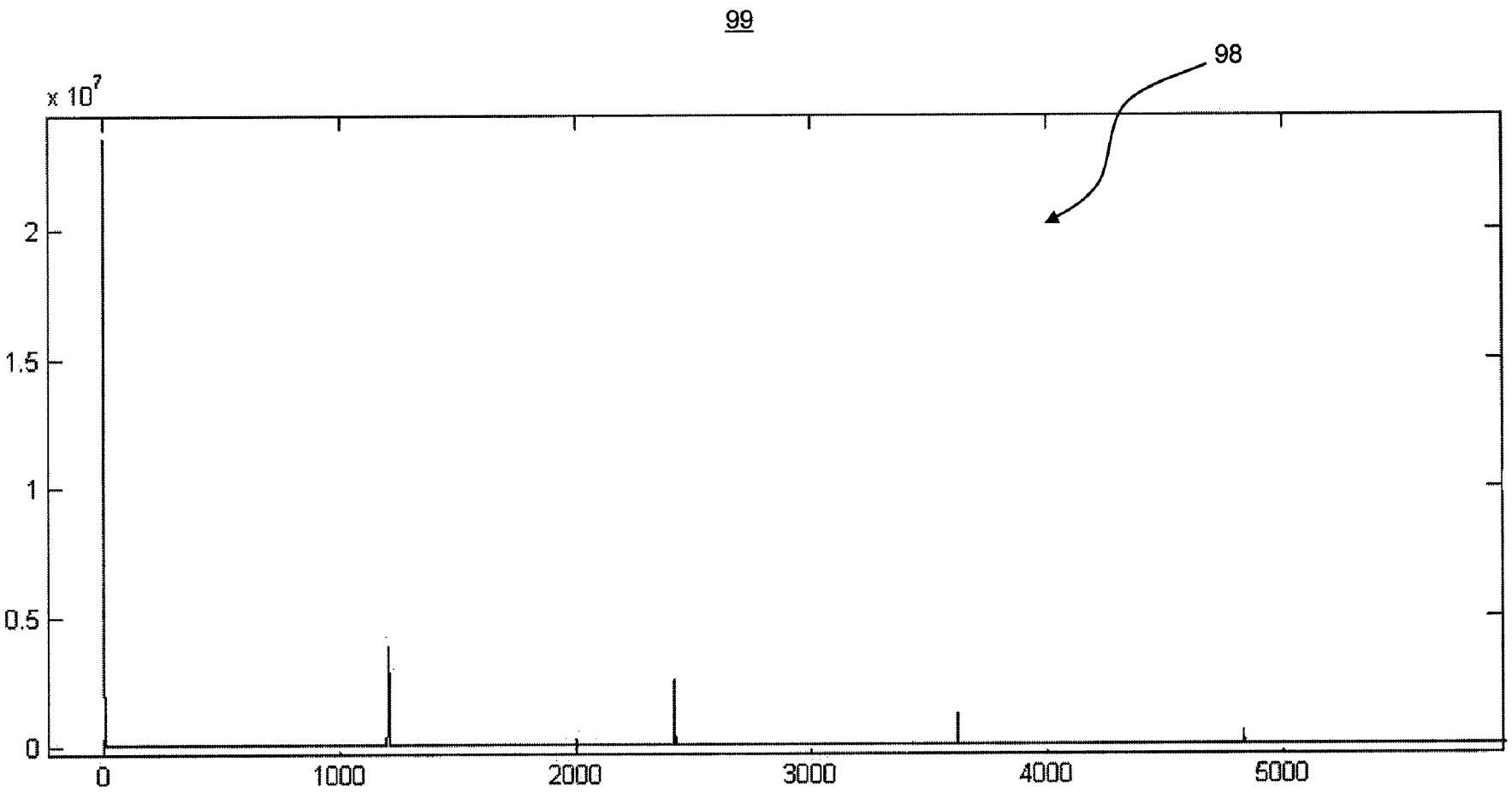
FIG. 9 is a graph illustrating a noise frequency spectrum made in accordance with the present invention and determined by selectively filtering for dominant frequencies in the noise frequency spectrum of FIG. 8.

Next, at least one and preferably all of the dominant frequencies 94 in the noise frequency spectrum 90 are identified (Block 222). The noise frequency spectrum 90 is then filtered for the identified dominant frequencies 94, in order to generate a filtered noise frequency spectrum 98, a portion of which is illustrated in the graph 99 of FIG. 9 (Block 224).

Typically, the filter 62 of FIG. 3B created in reference to Block 210, may be reused to selectively filter for the identified dominant frequencies 94, in creating the noise frequency spectrum 98.

Figure 10:
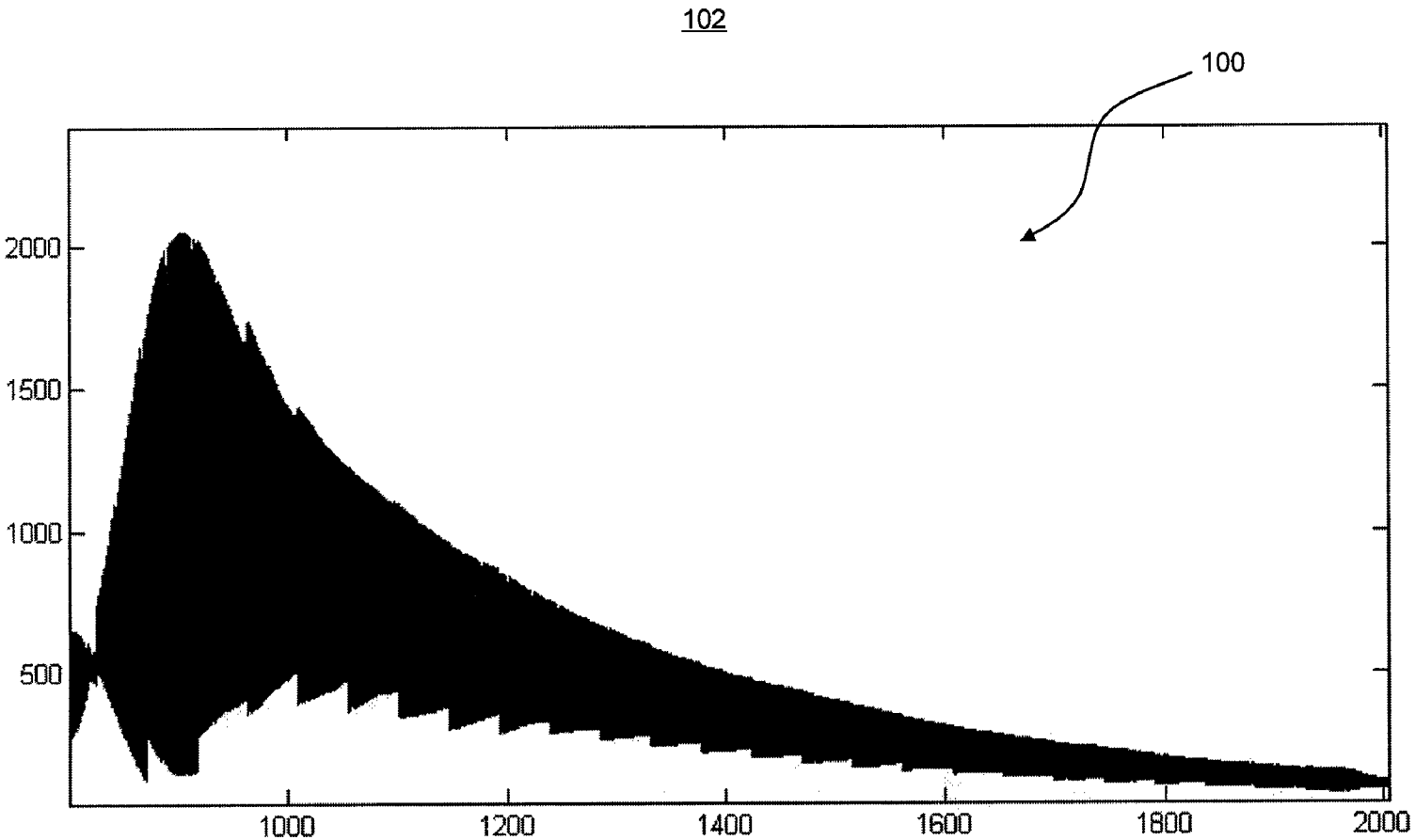
FIG. 10 is a graph illustrating a noise mass spectrum made in accordance with the present invention and determined by transforming the noise frequency spectrum of FIG. 9 into the mass domain.

Subsequently, a noise mass spectrum 100 as illustrated in the graph 102 of FIG. 10 is generated, typically by effecting an inverse Fourier Transformation of the noise frequency spectrum 98 data into the mass domain (Block 226).

To further refine the background signal estimate, in a manner similar to that discussed in relation to Block 216, the noise mass spectrum 100 data is revised such that for each correlated data point in the noise mass spectrum 100 and original mass spectrum 40 (correlated by sharing the same m/z value), the minimum intensity value of the two data points is determined (Block 228). In turn, the noise mass spectrum 100 is preferably modified by making the noise intensity data point equal to the minimum value (Block 230). As will be understood, the steps of Blocks 228 and 230 may be implemented using Equation 1, above.

Figure 11:
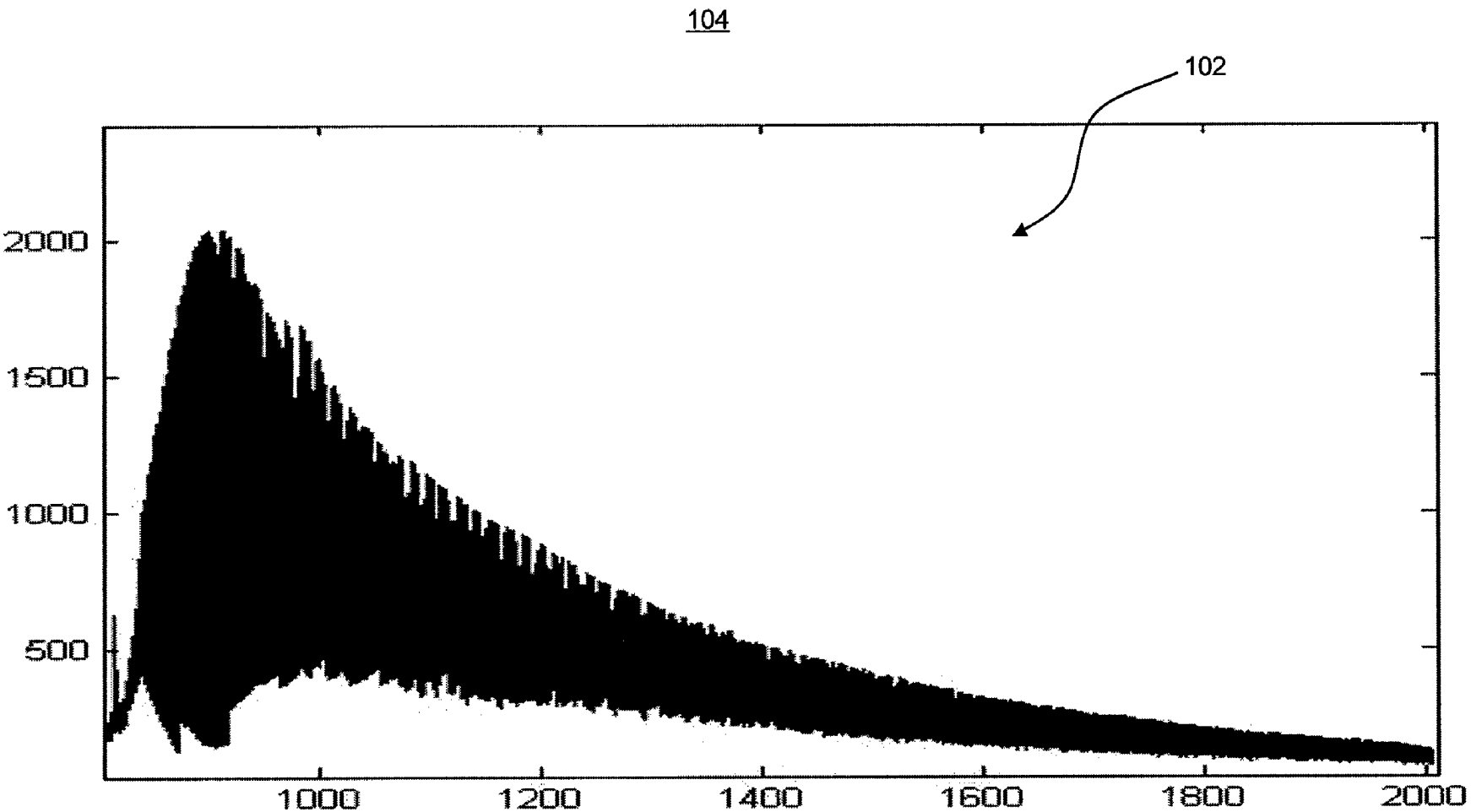
FIG. 11 is a graph illustrating the noise mass spectrum made in accordance with the present invention by determining the minimum value of each corresponding pair of intensity data points from the complete noise mass spectrum of FIG. 10 and the original mass spectrum of FIG. 2.

Completion of Block 230 for all of the correlated data points in the original and noise mass spectrums 40, 100, results in a modified noise mass spectrum 102, as illustrated in the graph 104 of FIG. 11 (Block 232).

The steps of Blocks 220 to 232 will preferably (but not necessarily) be repeated multiple times (as indicated by the line 233 in FIG. 13), each repetition further refining the background signal estimate (noise mass spectrum 102) and making it more closely approximate the actual background signal. The steps of Blocks 220 to 232 may be repeated a predetermined number of times (for example from 1 to 20 times, typically, but more repetitions may be necessary in some instances), or the engine 14 may be programmed to discontinue the repetitions automatically once the difference between the respective versions of the modified noise mass spectrum 102 data and the noise mass spectrum 100 data falls within a predetermined range.

Figure 12:
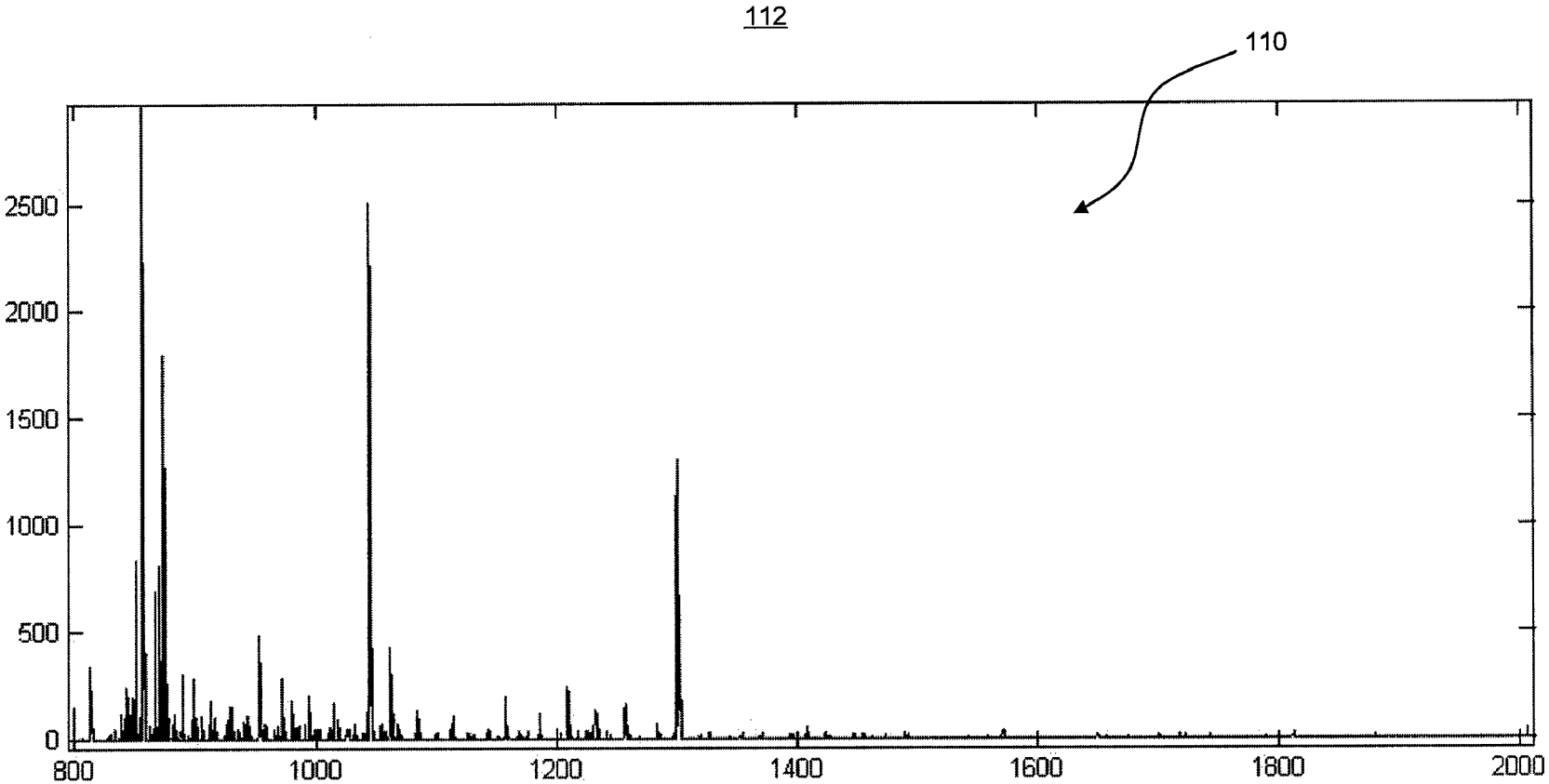
FIG. 12 is a graph illustrating a corrected mass spectrum made in accordance with the present invention and determined by subtracting the noise frequency spectrum of FIG. 11 from the original mass spectrum of FIG. 2.

Once the final version of the modified noise mass spectrum 102 has been determined, the noise mass spectrum 102 is subtracted from the original mass spectrum 40, resulting in a corrected mass spectrum 110 as illustrated in graph 112 in FIG. 12 (Block 250). As will be understood, the corrected mass spectrum 110 corresponds to the intended real signal of the sample to be analyzed, with a substantial portion of the background noise (present in the original mass spectrum 40) removed.

In an alternate embodiment 200', it has been found that improved results may sometimes be obtained by segmenting the original mass spectrum 40 into a plurality of initial windows 120 (as illustrated in FIG. 2 and separated by dotted lines) prior to Block 206 (Block 234). Typically, the windows 120 are of equal dimensions, although this is not required. Preferably, Blocks 206 through 212 inclusive are each completed separately for one initial window 120, before Blocks 206 through 212 are commenced and completed for another (typically successive) initial window 120, as indicated by dotted line 236.

Of course, as will be understood, the description above of each of Blocks 206 through 212 refer to mass spectrums and corresponding frequency domains as a whole. However, if the original mass spectrum 40 is to be processed by initial windows 120 separately pursuant to Block 234, as appropriate, references to whole mass spectrums and frequency domains in the descriptions for the Blocks 206 through 212 should be understood to refer to the mass spectrum and frequency domain segments corresponding to the initial window 120 being processed during the specific iteration of those Blocks.

Once the segmentation of the original mass spectrum 40 into initial windows 120 pursuant to Block 222 and the subsequent completion of Blocks 206 through 212 for each initial window 12 and the modified noise mass spectrum 80 has been generated pursuant to Blocks 214 through 218, the noise mass spectrum 80 is segmented into a series of a plurality of subsequent windows 130 (as illustrated in FIG. 7A) prior to Block 220 (Block 238). Preferably, the subsequent windows 130 in the series are configured such that no subsequent window 130 is coextensive with any initial window 12 in the mass domain. It is also preferable if (other than at the beginning and end of the mass spectrums), the windows 130 do not share a leading or termination edge (indicated by the dotted lines in FIG. 7A) with any initial windows 12.

Accordingly, if the subsequent windows 130 are configured to be generally of the same size as the initial windows 12, the subsequent window segments 130 will be shifted in the mass domain such that the first 130' and last 130" subsequent window segments will typically be smaller than the remainder of the subsequent windows 130.

Each of Blocks 220 through 226 inclusive is completed separately for one subsequent window 130 (including 130', 130"), before Blocks 220 through 226 are completed for another (typically successive) subsequent window 130, as indicated by dotted line 240. As with the initial embodiment discussed above, Blocks 220 through 232, may be repeated—for each subsequent repetition (as indicated by dotted line 233' instead of line 233) preferably a series of new subsequent windows is created in Block 238 such that no new subsequent window 130 is coextensive with any subsequent window 130 in any previous series. It is also preferable if (other than at the beginning and end of the mass spectrums), any new subsequent windows 130 do not share a leading or termination edge (indicated by the dotted lines in FIG. 7A) with any subsequent windows 120 in a previous series.

To avoid or minimize the overlap of leading or terminating edges, for each subsequent repetition, a series of new subsequent windows 130 may be configured to generally have the same size as previous series of windows 130, but be shifted in location relative to m/z value. Alternatively, the size of the windows 130 may be changed for different series of windows 130 to minimize the overlapping of leading or terminating edges.

Thus, while what is shown and described herein constitute preferred embodiments of the subject invention, it should be understood that various changes can be made without departing from the subject invention, the scope of which is defined in the appended claims.

The invention claimed is:

1. A method for reducing background noise in a mass spectrum, the method comprising the following steps:

(a) obtaining an original mass spectrum;

(b) determining a noise mass spectrum corresponding to background noise in the original mass spectrum;

(c) determining a corrected mass spectrum by subtracting the noise mass spectrum from the original mass spectrum; and (d) wherein step (b) comprises the steps of:

A) effecting a transformation of the original mass spectrum into the frequency domain to obtain an original frequency spectrum;

B) identifying at least one dominant frequency in the original frequency spectrum;

C) generating a noise frequency spectrum by selectively filtering for said at least one dominant frequency; and D) determining the noise mass spectrum by effecting a transformation of the noise frequency spectrum into the mass domain.

2. The method as claimed in claim 1, wherein the original mass spectrum comprises a plurality of original intensity data points and wherein the noise mass spectrum comprises a plurality of noise intensity data points such that each noise intensity data point correlates to an original intensity data point, step (b) of the method further comprising the following step:

E) for each correlated pair of original and noise intensity data points:

(i) determining the minimum value; and (ii) modifying the noise mass spectrum by making the noise intensity data point equal to the minimum value.

3. A spectrometer comprising a computer configured to carry out the method of claim 2.

4. The method as claimed in claim 3, step (b) further comprising the following steps:

F) effecting a transformation of the noise mass spectrum modified in step (E) into the frequency domain to obtain a noise frequency spectrum;

G) identifying at least one dominant frequency in the noise frequency spectrum;

H) modifying the noise frequency spectrum by selectively filtering for said at least one dominant frequency; and I) determining the noise mass spectrum by effecting a transformation of the noise frequency spectrum into the mass domain.

5. The method as claimed in claim 4, step (b) further comprising the following step:

J) repeating step (E) utilizing the noise mass spectrum determined in step (I).

6. The method as claimed in claim 5, further comprising repeating steps (F) through (J) inclusively.

7. The method as claimed in claim 6, further comprising the step of segmenting the original mass spectrum into a plurality of initial windows prior to step A, and separately effecting steps A through D inclusive for each initial window.

8. The method as claimed in claim 7, further comprises the step of segmenting the noise mass spectrum into a plurality of subsequent windows prior to step F, and separately effecting steps F through I inclusive for each subsequent window.

9. The method as claimed in claim 8, wherein the subsequent windows are configured such that no subsequent window is coextensive with any initial window.

10. The method as claimed in claim 9, further comprising the step of subsequent to step J, for each repeat of steps G through J, segmenting the noise mass spectrum into a plurality of new windows prior to step G, and separately effecting steps G through J inclusive for each new window, and wherein the new windows are configured such that no new window is coextensive with any subsequent window.

11. A computer system configured to carry out the method of claim 1.

12. A storage medium comprising a program configured to cause a computer system to carry out the method of claim 1.

* * * * *